US008382520B2

(12) United States Patent
Ritter

(10) Patent No.: US 8,382,520 B2
(45) Date of Patent: Feb. 26, 2013

(54) CONNECTOR ASSEMBLY

(75) Inventor: Christopher David Ritter, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 181 days.

(21) Appl. No.: 13/007,938

(22) Filed: Jan. 17, 2011

(65) Prior Publication Data

US 2012/0184136 A1 Jul. 19, 2012

(51) Int. Cl.
*H01R 13/648* (2006.01)

(52) U.S. Cl. ..... 439/607.05; 439/541.5

(58) Field of Classification Search ..... 439/79, 439/92, 541.5, 607.05–607.09
See application file for complete search history.

(56) References Cited

U.S. PATENT DOCUMENTS

| | | | | |
|---|---|---|---|---|
| 6,709,294 | B1 | 3/2004 | Cohen et al. | |
| 7,163,421 | B1 | 1/2007 | Cohen et al. | |
| 7,371,117 | B2 | 5/2008 | Gailus | |
| 7,789,676 | B2 | 9/2010 | Morgan et al. | |
| 2002/0168898 | A1 * | 11/2002 | Billman et al. | 439/608 |
| 2003/0220018 | A1 * | 11/2003 | Winings et al. | 439/608 |

* cited by examiner

*Primary Examiner* — Khiem Nguyen

(57) ABSTRACT

A connector assembly includes contact modules each having a dielectric frame and contacts held by the dielectric frame. The contacts are arranged along a contact plane within the frame. The dielectric frame includes frame members connected by connecting segments. The frame has windows between the frame members located between adjacent contacts. Holders support corresponding contact modules. The holders are electrically grounded. The holders each have a support wall and tabs that extend outward from the support wall. The contact modules are coupled to the holders such that the tabs are received in the windows to provide shielding within the contact modules. The holders are coupled together such that the contact modules are stacked together with the tabs of at least some of the holders that extend into the contact module held by the adjacent holder and across the contact plane defined by the contact module of the adjacent holder.

19 Claims, 11 Drawing Sheets

CONNECTOR ASSEMBLY

CROSS REFERENCE TO RELATED APPLICATIONS

This application relates to U.S. patent application Ser. No. 12/790,042 filed May 28, 2010, and to U.S. patent application Ser. No. 12/790,246 filed May 28, 2010, the subject matter of both of which are herein incorporated by reference in their entirety.

BACKGROUND OF THE INVENTION

The subject matter herein relates generally to shielded connector assemblies.

Some electrical systems utilize electrical connectors to interconnect two circuit boards, such as a motherboard and daughtercard. In some systems, to electrically connect the electrical connectors, a midplane circuit board is provided with front and rear header connectors on opposed front and rear sides of the midplane circuit board. Other systems electrically connect the circuit boards without the use of a midplane circuit board by directly connecting electrical connectors on the circuit boards.

However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, the shielding is selectively utilized along the signal paths, where portions of the signal paths remain unshielded.

A need remains for an electrical system that provides efficient shielding to meet particular performance demands.

BRIEF DESCRIPTION OF THE INVENTION

In one embodiment, a connector assembly is provided having contact modules each having a dielectric frame and contacts held by the dielectric frame. The contacts are arranged along a contact plane within the frame. The dielectric frame includes frame members connected by connecting segments. The frame has windows between the frame members located between adjacent contacts. Holders support corresponding contact modules. The holders are electrically grounded. The holders each have a support wall and tabs that extend outward from the support wall. The contact modules are coupled to the holders such that the tabs are received in the windows to provide shielding within the contact modules. The holders are coupled together such that the contact modules are stacked together with the tabs of at least some of the holders that extend into the contact module held by the adjacent holder and across the contact plane defined by the contact module of the adjacent holder.

In another embodiment, a connector assembly is provided having contact modules each having a dielectric frame and contacts held by the dielectric frame. The dielectric frame includes frame members connected by connecting segments. The connecting segments are narrower than the frame members to define notches between the frame members aligned with the connecting segments. The frame has windows between the frame members located between adjacent contacts. Holders support corresponding contact modules. The holders are electrically grounded. The holders each have a support wall and tabs that extend outward from the support wall. The contact modules are coupled to the holders such that the tabs are received in the windows to provide shielding within the contact modules between the contacts in adjacent frames members. The holders are coupled together such that the tabs of at least some of the holders extend into the notches between adjacent frame members.

In a further embodiment, a connector system is provided having a header assembly that includes header holders and header contact modules supported by the header holders. Each header contact module has a dielectric frame and contacts held by the dielectric frame along a contact plane within the frame. The dielectric frame includes frame members connected by connecting segments. The frame has windows between the frame members located between adjacent contacts. Each header holder has a support wall and tabs that extend outward from the support wall. The contact modules are coupled to the header holders such that the tabs are received in the windows to provide shielding within the contact modules. The header holders are coupled together such that the contact modules are stacked together with the tabs of at least some of the header holders extending into the contact module held by the adjacent header holder and across the contact plane defined by the contact module of the adjacent header holder. The header holders define a loading chamber at a front end of the header assembly.

The connector system may also include a receptacle assembly comprises receptacle holders and receptacle contact modules supported by the receptacle holders. Each receptacle contact module has a dielectric frame and contacts held by the dielectric frame along a contact plane within the frame. The dielectric frame includes frame members connected by connecting segments. The frame has windows between the frame members located between adjacent contacts. Each receptacle holder has a support wall and tabs that extend outward from the support wall. The contact modules are coupled to the receptacle holders such that the tabs are received in the windows to provide shielding within the contact modules. The holders are coupled together such that the contact modules are stacked together with the tabs of at least some of the receptacle holders extending into the contact module held by the adjacent receptacle holder and across the contact plane defined by the contact module of the adjacent receptacle holder. The receptacle assembly has a mating housing at a front end of the receptacle assembly. The mating housing has contact channels that receive the contacts of the receptacle contact module. The mating housing is received in the loading chamber of the header assembly.

DETAILED DESCRIPTION OF THE INVENTION

Figure 1:
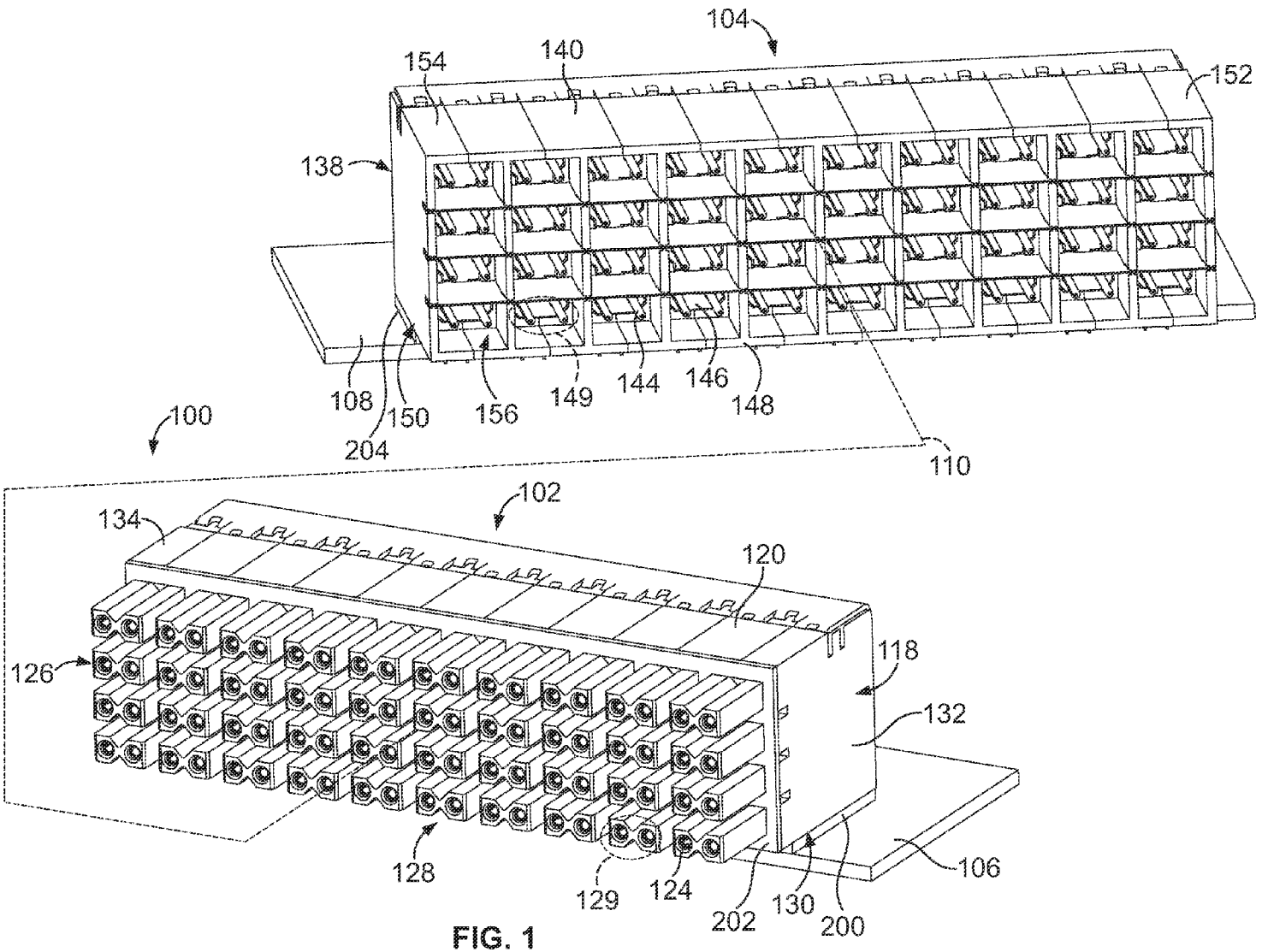
FIG. 1 is a perspective view of a connector system showing a header assembly and receptacle assembly.

FIG. 1 is a perspective view of an exemplary embodiment of a connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented coplanar to one another when the receptacle and header assemblies 102, 104 are mated. Alternative orientations of the circuit boards 106, 108 are possible in alternative embodiments. For example, the circuit boards 106, 108 may be parallel to one another, but non-coplanar with respect to one another. In some alternative embodiments, the circuit boards 106, 108 may be perpendicular to one another.

A mating axis 110 extends through the receptacle and header assemblies 102, 104. The receptacle and header assemblies 102, 104 are mated together in a direction parallel to and along the mating axis 110. In an exemplary embodiment, both the circuit boards 106, 108 extend approximately parallel to the mating axis 110.

In an exemplary embodiment, the receptacle assembly 102 is modular in design and may include any number of components that are coupled together to create the receptacle assembly 102, depending on the particular application. The receptacle assembly 102 includes a shield body 118 providing selective shielding around and within the shield body 118. The receptacle assembly 102 includes a plurality of holders 120 that support a plurality of contact modules 122 (shown in FIG. 2). The holders 120 define the shield body 118. For example, the holders 120 may be die cast, stamped and formed, metalized or otherwise made from a metal material to provide shielding for the contact modules 122 held by the holders 120.

The contact modules 122 each include a plurality of receptacle contacts 124. In the illustrated embodiment, the receptacle contacts 124 constitute socket contacts, however other types of contacts may be utilized in alternative embodiments, such as pin contacts, spring beams, tuning-fork type contacts, blade type contacts, and the like.

The holders 120 are modular in design, and any number of holders 120 may be provided and stacked together to form the shield body 118. The shield body 118 is thus defined by a plurality of individually shielded components that are coupled together to form a single body that provides electrical shielding for the receptacle contacts 124. Adding more holders 120 increases the number of contact modules 122 and thus the number of receptacle contacts 124. Alternatively, providing fewer holders 120 reduces the number of contact modules 122, and thus the number of receptacle contacts 124.

The receptacle assembly 102 includes a mating housing 126 at a mating end 128 of the receptacle assembly 102. The receptacle contacts 124 are received in the mating housing 126 and held therein for mating to the header assembly 104. The receptacle contacts 124 are arranged in a matrix of rows and columns. Any number of receptacle contacts 124 may be provided in the rows and columns. Optionally, the receptacle contacts 124 may be signal contacts arranged as differential pairs 129. The receptacle contacts 124 within each differential pair 129 are arranged within a common row and are part of different contact modules 122 and held in different holders 120. The holders 120 provide shielding between each differential pair 129, as described in further detail below. Optionally, the receptacle contacts 124 within each differential pair 129 may have the same length, and thus have a skewless design.

The receptacle assembly 102 includes a mounting end 130 that is mounted to the circuit board 106. Optionally, the mounting end 130 may be substantially perpendicular to the mating end 128. Alternatively, other configurations are possible, such as having the mounting end 130 substantially parallel to the mating end 128. The shield body 118 is arranged and exposed along the mounting end 130 for electrically grounding to the circuit board 106, such as by way of a conductive gasket 200, however other electrical commoning means or components may be used in alternative embodiments. The shield body 118 is arranged and exposed along the mating end 128 for electrically grounding to the header assembly 104, such as by way of a conductive gasket 202, however other electrical commoning means or components may be used in alternative embodiments. For example, the receptacle assembly 102 may utilize ground contacts or ground clips, such as those described in U.S. patent application Ser. No. 12/790,042 or U.S. patent application Ser. No. 12/790,246, the subject matter of both of which are herein incorporated by reference in their entirety.

The receptacle assembly 102 includes end holders 132, 134 at opposite ends of the receptacle assembly 102. The end holders 132, 134 differ from the intermediate holders 120 provided between the end holders 132, 134, as will be described in further detail below. The end holders 132, 134 also define a portion of the shield body 118. The end holders 132, 134 hold contact modules 122 therein.

In an exemplary embodiment, the header assembly 104 is modular in design and may include any number of components that are coupled together to create the header assembly 104, depending on the particular application. The header assembly 104 includes a shield body 138 providing selective shielding around and within the shield body 138. The header assembly 104 includes a plurality of holders 140 that support a plurality of contact modules 142 (shown in FIG. 11). The holders 140 define the shield body 138. The contact modules 142 each include a plurality of header contacts 144. In the illustrated embodiment, the header contacts 144 constitute pin contacts, however other types of contacts may be utilized in alternative embodiments, such as socket contacts, spring beams, tuning-fork type contacts, blade type contacts, and the like. Any number of holders 140 may be provided.

The header assembly 104 includes a plurality of mating housings 146 at a mating end 148 of the header assembly 104. The mating housings 146 are manufactured from a dielectric material and isolate the header contacts 144 from the holders 140. The header contacts 144 are received in corresponding mating housings 146 and held therein for mating to the receptacle contacts 124 of the receptacle assembly 102. Optionally, the header contacts 144 may be signal contacts arranged as differential pairs 149. The header contacts 144 within each differential pair 149 are arranged within a common row and are part of different contact modules 142 and held in different holders 140. Optionally, the header contacts 144 within each differential pair 149 may have the same length, and thus have a skewless design.

The header assembly 104 includes a mounting end 150 that is mounted to the circuit board 108. Optionally, the mounting end 150 may be substantially perpendicular to the mating end 148. Alternatively, other configurations are possible, such as having the mounting end 150 substantially parallel to the mating end 148. The shield body 138 is arranged along the mounting end 150 for electrically grounding to the circuit board 108, such as by way of a conductive gasket 204, however other electrical commoning means or components may be used in alternative embodiments. The shield body 138 is exposed at the mating end 148 for engaging the conductive gasket 202 to electrically common the shield body 138 and the shield body 118 of the receptacle assembly 102. The shield bodies 118, 138 may be electrically commoned by other components in alternative embodiments.

In an exemplary embodiment, the header assembly 104 includes end holders 152, 154 at opposite ends of the header assembly 104. The end holders 152, 154 differ from the intermediate holders 140 provided between the end holders 152, 154, as will be described in further detail below. The end holders 152, 154 also define a portion of the shield body 138. The end holders 152, 154 hold contact modules 142 therein. When assembled, the holders 140 and end holders 152, 154 cooperate to define a loading chamber 156 at the mating end 148. The loading chamber 156 is configured to receive a portion of the receptacle assembly 102, such as the mating housing 126. The receptacle assembly 102 is loaded into the loading chamber 156 along the mating axis 110 (shown in FIG. 10). The receptacle contacts 124 are mated to the header contacts 144 in the loading chamber 156. In an exemplary embodiment, the connector system 100 may be reversible, wherein the receptacle assembly 102 may be received in the header assembly 104 in two different orientations (e.g. 180° from each other). The size, shape and/or orientation of the mating interfaces are such that the receptacle assembly 102 may be loaded into the loading chamber 156 right side up or upside down.

Figure 2:
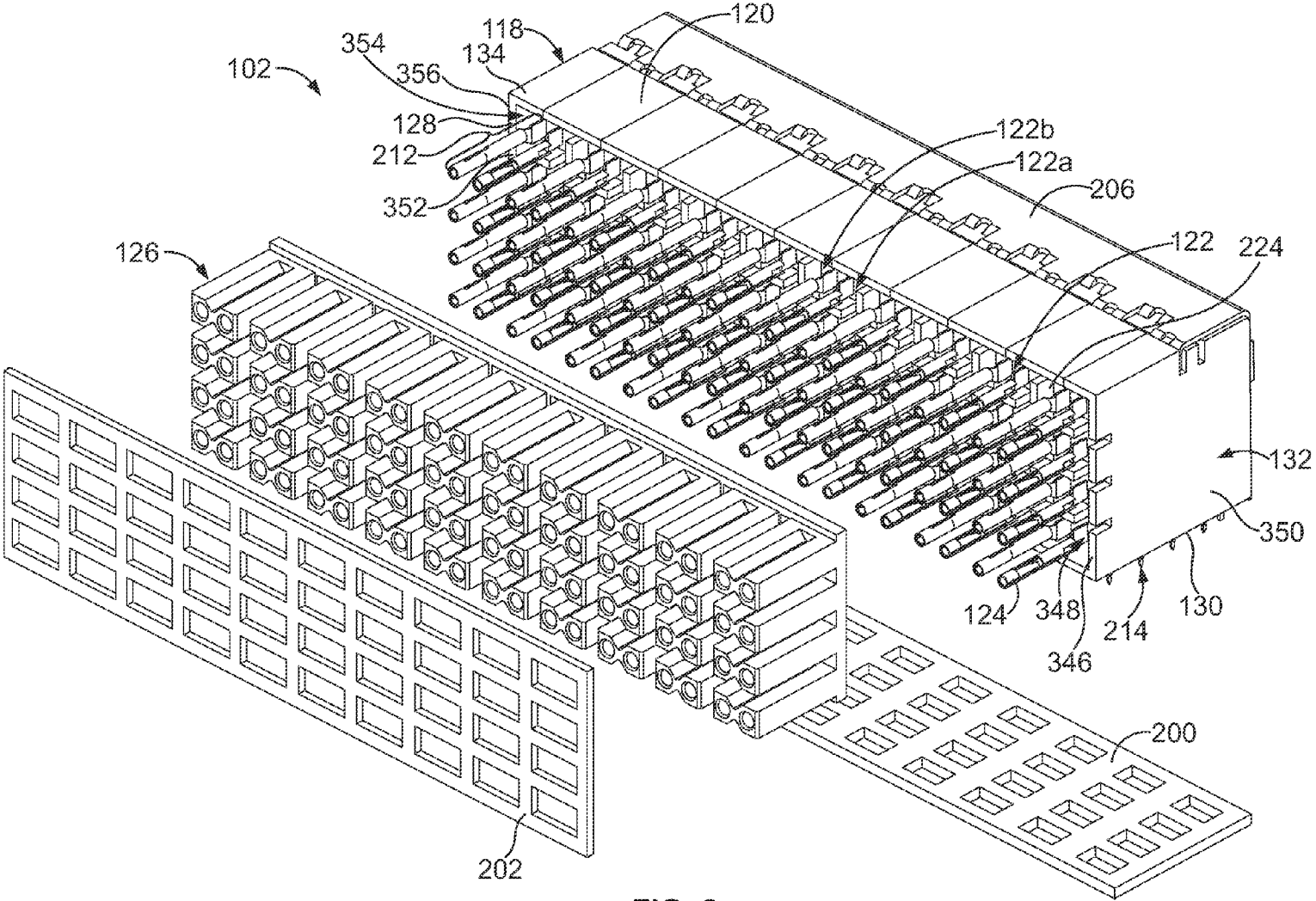
FIG. 2 is an exploded view of the receptacle assembly shown in FIG. 1.

FIG. 2 is an exploded view of the receptacle assembly 102. FIG. 2 illustrates the contact modules 122 loaded into corresponding holders 120. The mating housing 126 is poised for mounting to the holders 120. FIG. 2 also illustrates the conductive gasket 200 configured to be coupled to the mounting end 130 of the receptacle assembly 102 and the conductive gasket 202 configured to be coupled to the mating end 128. The conductive gaskets 200, 202 may be similar to the conductive gasket described in concurrently filed U.S. patent application Ser. No. 12/790,042 the complete subject matter of which is herein incorporated by reference in its entirety.

The conductive gasket 200 defines a ground path between the shield body 118 of the receptacle assembly 102 and the circuit board 106 (shown in FIG. 1). For example, the conductive gasket 200 may engage, and be electrically connected to the holders 120 to electrically common the holders 120 to a ground circuit on the circuit board 106. The conductive gasket 202 defines a ground path between the shield body 118 of the receptacle assembly 102 and the shield body 138 (shown in FIG. 1) of the header assembly 104 (shown in FIG. 1). For example, the conductive gasket 202 may engage, and be electrically connected to the holders 120 and the holders 140 (shown in FIG. 1) to electrically common the holders 120 to the holders 140.

The receptacle assembly 102 includes a retainer 206 coupled to each of the holders 120 and end holders 132, 134. The retainer 206 secures together each of the holders 120 and end holders 132, 134. Optionally, the holders 120 and end holders 132, 134 may be coupled directly to one another, such as using alignment or securing features integrated into the holders 120 and end holders 132, 134. Once held together, the holders 120 and end holders 132, 134 form the shield body 118 which structurally supports the contact modules 122 and electrically shields the receptacle contacts 124.

The receptacle contacts 124 include mating portions 212 that extend forward for mating with the header contacts 144 (shown in FIG. 1). The mating portions 212 are configured to be loaded into the mating housing 126. The receptacle contacts 124 include mounting portions defined by contact tails 214 extending downward for mounting to the circuit board 106. The contact tails 214 may be compliant pins, such as eye-of-the-needle contacts, that may be press fit into plated vias in the circuit board 106.

Figure 4:
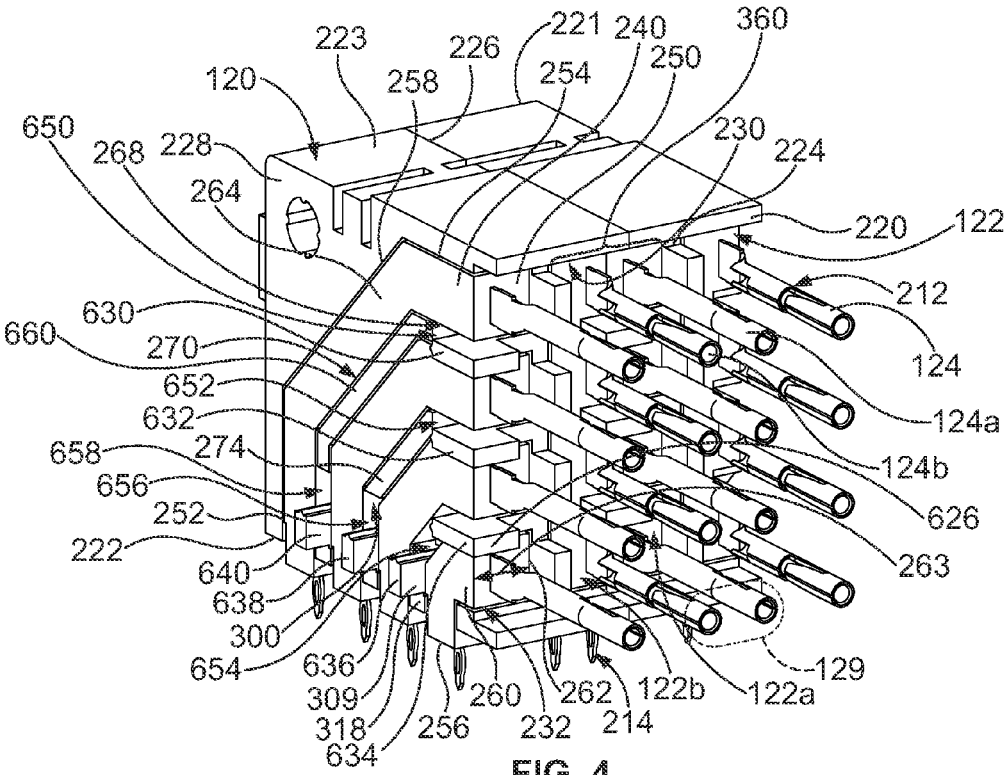
FIG. 4 is a front perspective view from another side of the contact modules and holders shown in FIG. 3.
Figure 3:
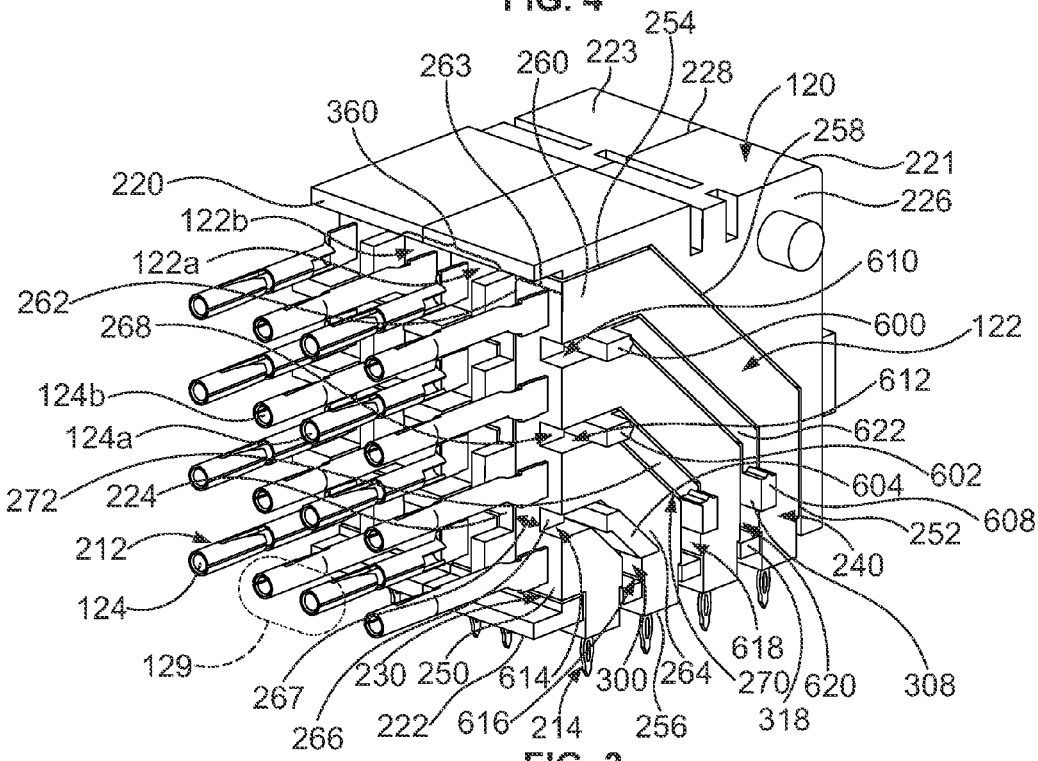
FIG. 3 is a front perspective view from one side of a portion of the receptacle assembly showing a plurality of contact modules and plurality of holders.

FIGS. 3 and 4 are front perspective views from different sides of a portion of the receptacle assembly 102 showing a plurality of contact modules 122 and a plurality of holders 120. In an exemplary embodiment, the intermediate holders 120, as opposed to the end holders 132, 134 (shown in FIG. 1) are identical to one another. Alternatively, the holders 120 may be different from one another. For example, the holders 120 may come in pairs, with pairs of the holders 120 having different features and the pairs being configured to be mated with other pairs.

Each holder 120 includes a body configured to support a plurality of the contact modules 122. The body defines a portion of the shield body 118 (shown in FIG. 1). The holder 120 includes a front 220 and a rear 221. The holder 120 includes a bottom 222 and a top 223. In the illustrated embodiment, each holder 120 supports two contact modules 122. More or less contact modules 122 may be supported by a particular holder 120 in alternative embodiments.

In an exemplary embodiment, the holder 120 is fabricated from a conductive material. For example, the holder 120 may be die-cast from a metal material. Alternatively, the holder 120 may be stamped and formed or may be fabricated from a plastic material that has been metalized or coated with a metallic layer. By having the holder 120 fabricated from a conductive material, the holder 120 may define a ground shield for the receptacle assembly 102. A separate ground shield does not need to be provided and coupled to the contact modules 122 prior to assembling together the contact modules 122. Rather, the holders 120 define the ground shield and also support the contact modules 122 as part of the shield body 118. When the holders 120 are ganged together, the holders 120 define the shield body 118 of the receptacle assembly 102. The holders 120 may be ganged together by coupling the individual holders 120 to one another or by using a separate component, such as the retainer 206 (shown in FIG. 2). The holders 120 are ganged together such that the contact modules 122 are stacked parallel to one another. Portions of the holders 120 may extend between respective contact modules 122 to provide electrical shielding therebetween.

The holders 120 provide electrical shielding between and around respective contact modules 122. The holders 120 provide shielding from electromagnetic interference (EMI) and/or radio frequency interference (RFI). The holders 120 may provide shielding from other types interference as well. The holders 120 provide shielding around the contact modules 122 and/or between the receptacle contacts 124 of the contact modules 122 to control electrical characteristics, such as impedance control, cross-talk control, and the like, of the receptacle contacts 124. For example, by having the holders 120 electrically grounded, the holders 120 provide shielding for the contact modules 122 to control the electrical characteristics.

In the illustrated embodiment, the holders 120 provide shielding along the top, back, front and bottom of the contact modules 122. Optionally, the holders 120 may provide shielding between any or all of the contact modules 122 and/or between any or all of the receptacle contacts 124. For example, as in the illustrated embodiment, each holder 120 includes a support wall 224. The support wall 224 is provided between the pair of contact modules 122 held by the holder 120. The support wall 224 provides shielding between the contact modules 122 held by the holder 120. Optionally, the support wall 224 may be substantially centrally located between opposite sides 226, 228 of the holder 120. The holder 120 includes a first receptacle chamber 230 at the first side 226 and a second receptacle chamber 232 at the second side 228. Each receptacle chamber 230, 232 receives one of the contact modules 122 therein. The contact modules 122 are loaded into the corresponding receptacle chambers 230, 232 such that the contact modules 122 abut against the support wall 224. Alternatively, the receptacle chambers 230 and/or 232 may receive more than one contact module 122. In other alternative embodiments, only one receptacle chamber is provided in each holder 120, with the receptacle chamber receiving one, two or more contact modules 122 therein.

Each contact module 122 includes a dielectric frame 240 surrounding the receptacle contacts 124. In an exemplary embodiment, the receptacle contacts 124 are initially held together as a lead frame 242 (shown in FIG. 5), which is overmolded with a dielectric material to form the dielectric frame 240. After the lead frame 242 is overmolded, the receptacle contacts 124 are separated from one another. Manufacturing processes other than overmolding a lead frame may be utilized to form the contact modules 122, such as loading receptacle contacts 124 into a formed dielectric body.

Each of the receptacle contacts 124 includes one of the contact tails 214 at one end thereof, and one of the mating portions 212 at an opposite end thereof. The mating portions 212 and contact tails 214 are the portions of the receptacle contacts 124 that extend from the dielectric frame 240. In an exemplary embodiment, the mating portions 212 extend generally perpendicular with respect to the contact tails 214. Inner portions or encased portions of the receptacle contacts 124 transition between the mating portions 212 and the contact tails 214 within the dielectric frame 240. In other embodiments, the mating portions 212 may be non-perpendicular with respect to the contact tails 214. For example, the mating portions 212 may be parallel to the contact tails 214. Optionally, the mating portions 212 may be axially aligned with the contact tails 214.

The dielectric frame 240 includes a front wall 250, a rear wall 252 generally opposite the front wall 250, a top wall 254 and a bottom wall 256 generally opposite the top wall 254. Optionally, the dielectric frame 240 may include a slant wall 258 extending between the top wall 254 and the rear wall 252. The slant wall 258 is angled with respect to the top wall 254 and the rear wall 252. In an exemplary embodiment, the front and rear walls 250, 252 are parallel to one another and the top and bottom walls 254, 256 are parallel to one another and generally perpendicular with the respect to the front and rear walls 250, 252. The mating portions 212 of the receptacle contacts 124 extend from the front wall 250 of the dielectric frame 240. The contact tails 214 of the receptacle contacts 124 extend from the bottom wall 256 of the dielectric frame 240. Other configurations are possible in alternative embodiments.

The dielectric frame 240 includes a first side 260 and a second side 262 generally opposite the first side 260. The first and second sides 260, 262 are generally parallel to the sides 226, 228 of the holder 120. The dielectric frame 240 has a width 263 between the first and second sides 260, 262. The first side 260 represents an outer side of the dielectric frame 240 that is exposed exterior of the holder 120. The second side 262 represents an inner side of the dielectric frame 240 that is loaded into the corresponding receptacle chamber 230 against the support wall 224. In an exemplary embodiment, two types of contact modules 122 may be utilized, namely an "A" module and a "B" module. Optionally, the A and B modules may be mirrored versions of one another. In the orientation illustrated in FIGS. 3 and 4, the A module has the first side 260 on the right side and the second side 262 on the left side (e.g. against the support wall 224) from the perspective shown in FIGS. 3 and 4. In contrast, the B module has the first side 260 on the left side and the second side 262 on the right side (e.g. against the support wall 224) from the perspective shown in FIGS. 3 and 4.

The dielectric frame 240 includes a plurality of frame members 264. The frame members 264 hold the receptacle contacts 124. For example, each receptacle contact 124 extends along, and inside of, a corresponding frame member 264. The frame members 264 encase the receptacle contacts 124. The frame members 264 are elongated and generally follow the paths of the receptacle contacts 124 between the contact tails 214 and the mating portions 212.

The frame members 264 are spaced apart from one another and interconnected by connecting segments 266. Optionally, each frame member 264 is connected to an adjacent frame member 264 by more than one connecting segment 266. In the illustrated embodiment, two connecting segments 266 are provided between each adjacent frame member 264. The connecting segments 266 are provided proximate to, or at, the front wall 250 and proximate to, or at, the bottom wall 256. The connecting segments 266 may be provided at other locations in alternative embodiments. The connecting segments 266 are integrally formed with the frame members 264, such as during a common molding process, to hold each of the individual frame members 264 together as a unit. As such, multiple frame members 264 may be simultaneously loaded into the holder 120 as a unit.

The connecting segments 266 are narrower than the frame members 264. In an exemplary embodiment, the dielectric frame 240 includes notches 268 aligned with the connecting segments 266. The notches 268 extend inward from the first side 260 to the connecting segment 266. As such, the connecting segments 266 have a width 267 that is less than the width 263 of the dielectric frame 240. Optionally, the notches 268 may extend at least half way through the dielectric frame 240, such that the width 267 of the connecting segments 266 is less than half the width 263 of the dielectric frame 240. The notches 268 are formed during the overmolding process that forms the dielectric frame 240. For example, the dielectric frame 240 is formed around molding elements that have a predetermined size and shape. The molding elements define the size, shape and position of the notches 268. The connecting segments 266 are the portions of the mold that remain between the frame members 264 when the molding elements are removed.

The dielectric frame 240 includes a plurality of windows 270 extending through the dielectric frame 240 between the frame members 264. The windows 270 separate the frame members 264 from one another. In an exemplary embodiment, the windows 270 extend entirely through the dielectric frame 240 between the first and second sides 260, 262. The windows 270 are internal of the dielectric frame 240 and located between adjacent receptacle contacts 124, which are held in the frame members 264. The windows 270 extend along lengths of the receptacle contacts 124 between the contact tails 214 and the mating portions 212. Optionally, the windows 270 may extend along a majority of the length of each receptacle contact 124 measured between the corresponding contact tail 214 and mating portion 212. The windows 270 are elongated and generally follow the paths of the receptacle contacts 124 between the contact tails 214 and the mating portions 212. The windows 270 are formed during the overmolding process that forms the dielectric frame 240. For example, the dielectric frame 240 is formed around molding elements that have a predetermined size and shape. The molding elements define the size, shape and position of the windows 270.

In the illustrated embodiment, the connecting segments 266 define ends of the windows 270. The windows 270 extend from the connecting segments 266 at the front wall 250 to the connecting segments 266 at the bottom wall 256. The windows 270 are open to the notches 268 at the first side 260, with no portion of the frame members 264 between the windows and the notches 268. Alternatively, the windows 270 and notches 268 may be separated from one another by connecting segments 266 or portions of the frame members 264.

In an exemplary embodiment, as described in further detail below, the holders 120 include tabs 272, 274 that extend into the notches 268 and the windows 270 when the contact modules 122 are coupled to the holders 120 and when the holders 120 are coupled together. The tabs 272, 274 support the contact modules 122 within the corresponding receptacle chambers 230, 232. The tabs 272, 274 provide shielding between the adjacent receptacle contacts 124.

Figure 5:
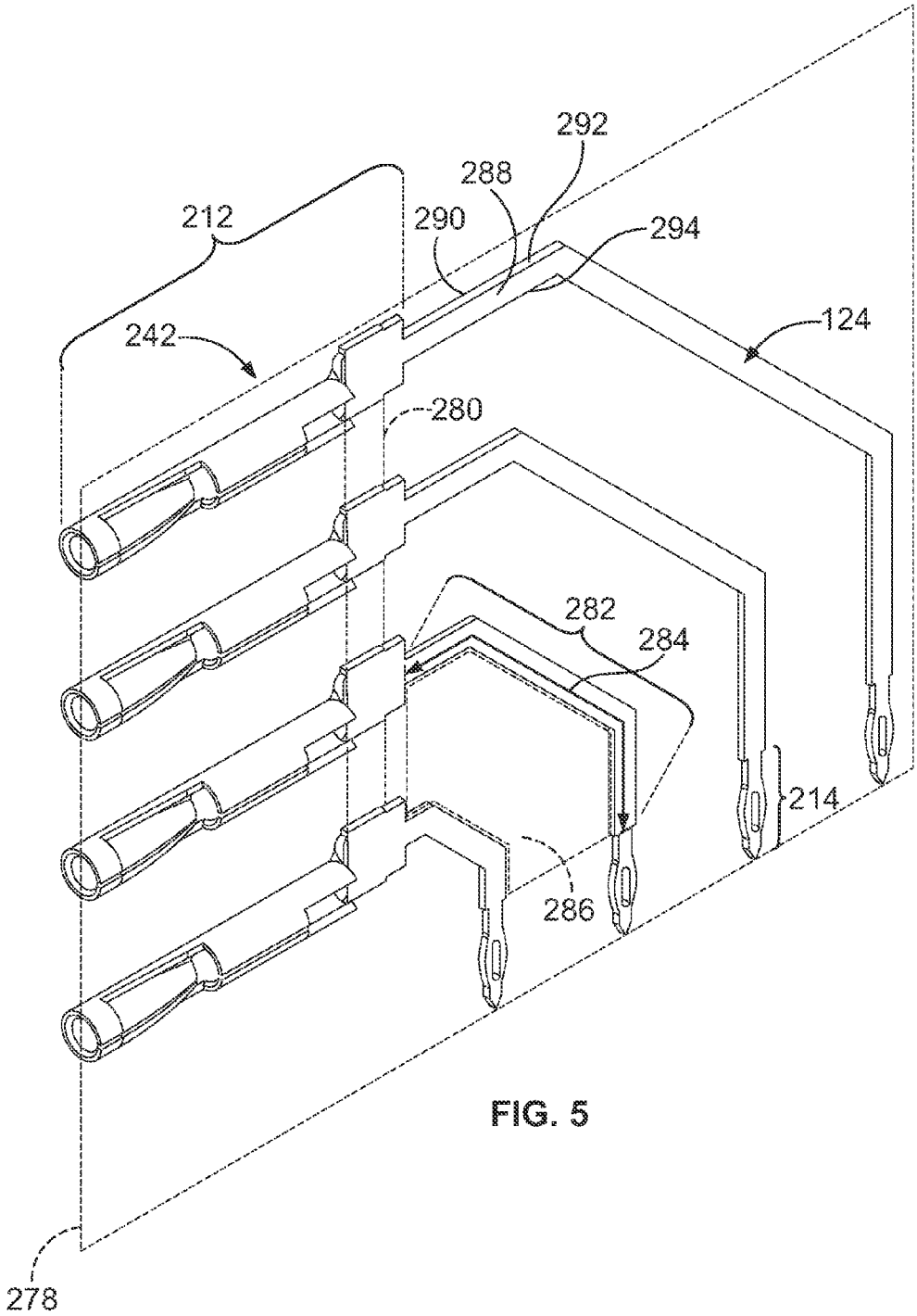
FIG. 5 is a front perspective view of a lead frame for one of the contact modules.

FIG. 5 is a front perspective view of the lead frame 242 for one of the contact modules 122 (shown in FIG. 4). The lead frame 242 includes a plurality of the receptacle contacts 124. The receptacle contacts 124 are manufactured by stamping and forming the receptacle contacts 124 from a stock piece of metal material. Each of the receptacle contacts 124 is manufactured from the same piece of material. During manufacturing, the receptacle contacts 124 are initially held together by a carrier 280 (shown in phantom in FIG. 5). The carrier 280 maintains the relative positions of the receptacle contacts 124 during the overmolding process that forms the dielectric frame 240 (shown in FIG. 4). The receptacle contacts 124 are held along and define a contact plane 278. Optionally, portions of the receptacle contacts 124 may transition out of the contact plane 278. The contact plane 278 may be defined as the plane in which a majority of the receptacle contacts 124 reside. The contact plane may be defined as the median plane of the receptacle contacts 124. The contact plane 278 may be defined as the mid-plane of the contact module 122.

After the lead frame 242 is overmolded, the carrier 280 is removed, thus separating the receptacle contacts 124 from one another. The receptacle contacts 124 are maintained within the dielectric frame 240 (shown in FIGS. 3 and 4) along the contact plane 278. The receptacle contacts 124 may be manufactured from a different process other than stamping and forming, such as etching, in alternative embodiments.

Each of the receptacle contacts 124 includes one of the contact tails 214 and one of the mating portions 212. The contact tails 214 and/or the mating portions 212 may be transitioned out of the contact plane 278. The transition section 282 may also transition out of the contact plane 278. In the illustrated embodiment, the contact tails 214 constitute press-fit pins that are configured to be received in plated vias of the circuit board 106 (shown in FIG. 1). The mating portions 212 constitute socket contacts having a generally barrel shape that is configured to receive the header contacts 144 (shown in FIG. 1). The mating portions 212 may be formed by rolling the ends of the receptacle contacts 124 into a barrel shape.

The receptacle contacts 124 include transition sections 282 between the contact tails 214 and mating portions 212. The transition sections 282 have lengths 284 measured between the contact tails 214 and mating portions 212. The lengths 284 of the receptacle contacts 124 are respectively different, with the inner receptacle contact 124 (closest to the bottom) being the shortest and the outer receptacle contact 124 (closest to the top) being the longest. The transition sections 282 are generally the portions of the receptacle contacts 124 that are encased within the dielectric frame 240. A transition area 286 is defined between the transition sections 282 of adjacent receptacle contacts 124. The windows 270 (shown in FIGS. 3 and 4) are aligned with the transition areas 286 when the contact module 122 is formed. The windows 270 are spaced apart from, and positioned between, adjacent receptacle contacts 124.

The transition sections 282 of the receptacle contacts 124 have a generally rectangular cross-section. The transition sections have broadsides 288, 290 and edge sides 292, 294. The broadsides 288, 290 are wider than the edge sides 292, 294. Optionally, when stamped and formed, the edge sides 292, 294 are defined by the cuts of the stamping process. The edge sides 292, 294 of adjacent receptacle contacts 124 face one another and are aligned with one another across the transition areas 286. The broadsides 288, 290 are generally parallel to the contact plane 278. The edge sides 292, 294 are generally perpendicular to the broadsides 288, 290 and the contact plane 278.

Figure 7:
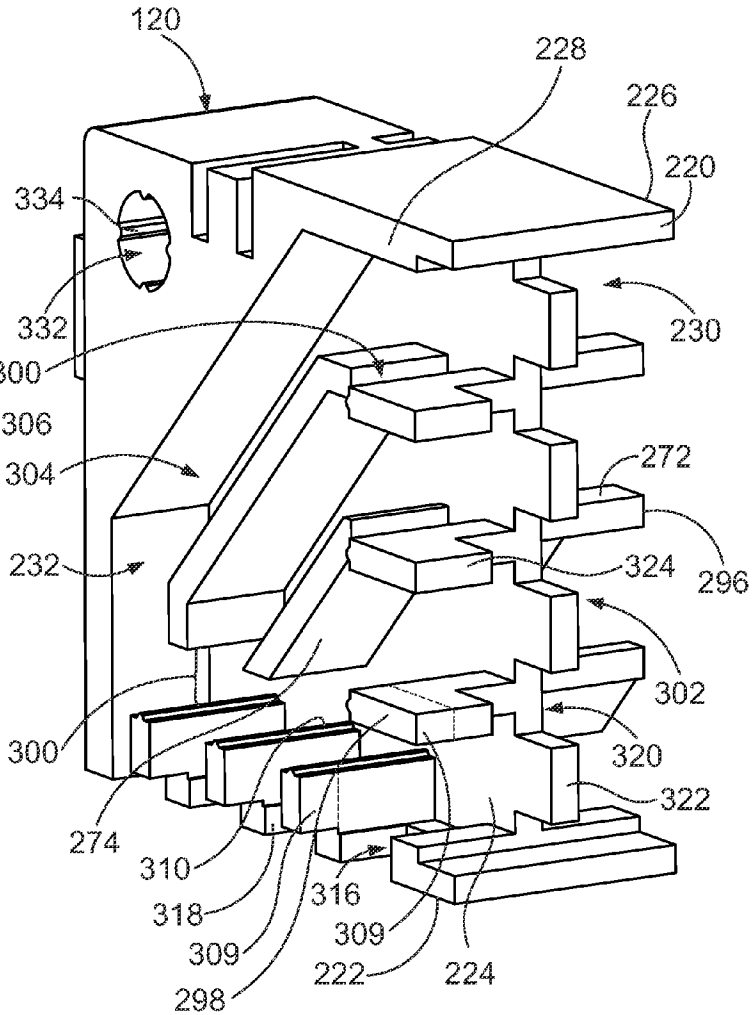
FIG. 7 is a front perspective view of another side of one of the holders.
Figure 6:
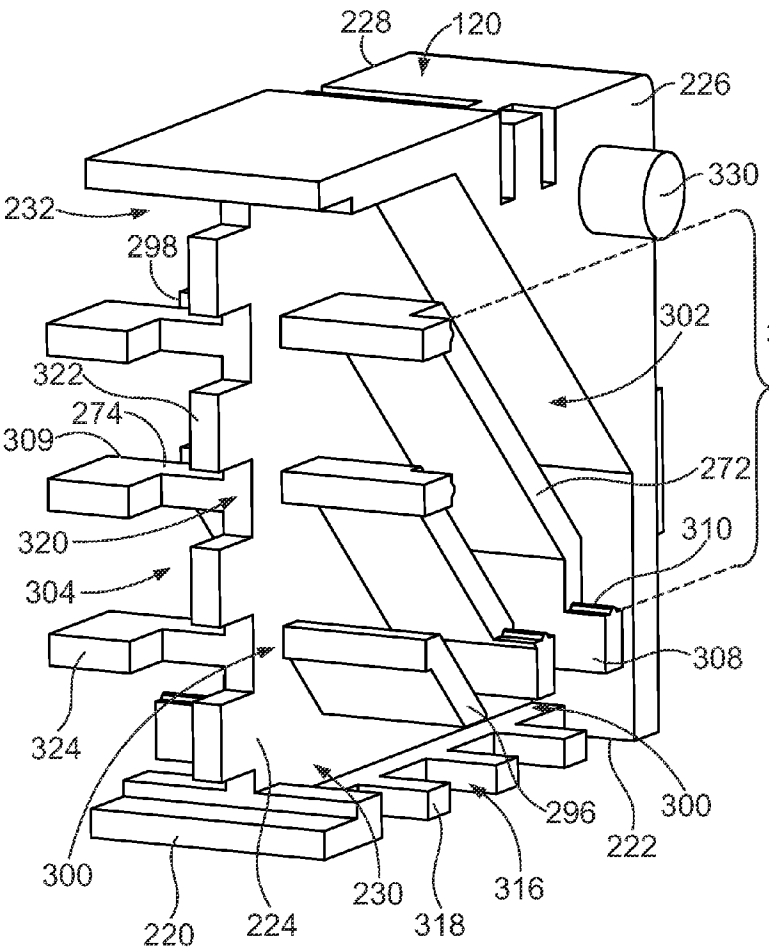
FIG. 6 is a front perspective view of a first side of one of the holders.

FIG. 6 is a front perspective view of the first side 226 of one of the holders 120. FIG. 7 is a front perspective view of the second side 228 of one of the holders 120. The support wall 224 is generally centrally located between the first and second sides 226, 228. The support wall 224 is substantially planar and defines an inner surface of the first and second receptacle chambers 230, 232.

The tabs 272 extend outward from the support wall 224 into the first receptacle chamber 230 to edges 296. The tabs 274 extend outward from the support wall 224 into the second receptacle chamber 232 to edges 298. Optionally, the edges 296, 298 may be coplanar with the sides 226, 228, respectively, of the holder 120. As described above, the tabs 272, 274 are configured to be received in the notches 268 and/or windows 270 (both shown in FIGS. 3 and 4) of an adjacent holder 120. In the illustrated embodiment, the tabs 272, 274 define ledges that support the contact modules 122 (shown in FIGS. 3 and 4) when the contact modules 122 are loaded into the receptacle chambers 230, 232. The tabs 272, 274 generally extend along non-linear paths (shown by the dashed lines) between the front 220 and the bottom 222 of the holder 120. In the illustrated embodiment, the tabs 272, 274 are non-continuous along the paths, with each tab 272, 274 including multiple tab segments separated by tab openings 300.

In an exemplary embodiment, the tabs 272, 274 are integrally formed with the support wall 224 and the other portions of the holders 120. Optionally, the holders 120 may be die-cast to form the support wall 224 and the tabs 272, 274. Being integral with the support wall 224 and other parts of the holder 120, the tabs 272, 274 form part of the shield body 118 (shown in FIG. 1).

The tabs 272 extend into the receptacle chamber 230 such that channels 302 are formed on both sides of each tab 272. Optionally, the channels 302 may be open to one another at the tab openings 300 to receive the connecting segments 266 (shown in FIG. 3). Similarly, the tabs 274 extend into the receptacle chamber 232 such that channels 304 are defined on both sides of the tabs 274. The channels 302, 304 receive respective frame members 264 (shown in FIG. 3) of contact modules 122 therein.

In an exemplary embodiment, the tabs 272, 274 are configured to be interdigitated when the holders 120 are ganged together. For example, the tabs 272 may have slots 306 in addition to the tab openings 300. The slots 306 are negative spaces formed within the body of the tab 272, where a portion of the tab remains between the slot 306 and the support wall 224. The tab openings 300 are spaces between tab segments of the tab 272. The tab openings 300 extend to the support wall 224 such that the support wall 224 is exposed at the bottom of the tab opening 300.

The tabs 272, 274 include projections 308, 309, respectively, extending outward from the edges 296, 298 of the tabs 272, 274. The projections 308, 309 are configured to be received within corresponding slots 306 and/or tab openings 300 of an adjacent holder 120. When the projections 308, 309 are received in the slots 306 of the adjacent holders 120, the projections 308, 309 are at least partially received in the windows 270 of the contact module 122 held by the adjacent holder 120. When the projections 308, 309 are received in the tab openings 300 of the adjacent holders 120, the projections 308, 309 are at least partially received in the notches 268 of the contact module 122 held by the adjacent holder 120.

Optionally, as in the illustrated embodiment, the tabs 272 may include bulges 310 along one or more of the walls forming the slots 306 and/or tab openings 300. The bulges 310 engage the projections 308, 309 when the holders 120 are coupled together. Alternatively, the projections 308, 309 may include bulges along side walls thereof that engage the walls of the slots 306 and/or tab openings 300 when the holders 120 are mated together. Having the projections 308, 309 received in the slots 306 and/or tab openings 300, allows the adjacent holders 120 to be electrically commoned proximate to the contact modules 122. Additionally, having multiple points of contact between the holders 120 allows the holders 120 to be electrically commoned at more than one location along the holders 120. Optionally, the bulges 310 define the points of contact between holders 120.

The bottom 222 of the holder 120 includes a plurality of openings 316. Fingers 318 are provided between each of the openings 316. The fingers 318 may form part of the tabs 272, 274, or alternatively, may be separate from the tabs 272, 274. Portions of the contact modules 122 are configured to be received in the openings 316 when the contact modules 122 are loaded into the first and second receptacle chambers 230, 232. The fingers 318 are positioned between such portions of the contact modules 122 to provide electrical shielding between the receptacle contacts 124. The bottom 222 of the holder 120 also provides a surface for interfacing with the conductive gasket 200 (shown in FIG. 2).

The front 220 includes a plurality of openings 320 separated by fingers 322. The fingers 322 may form part of the support wall 224. The mating housing 126 (shown in FIG. 2) is received in the openings 320 when the receptacle assembly 102 (shown in FIG. 2) is assembled. Distal ends of the fingers 322 may provide a surface for interfacing with the conductive gasket 202 (shown in FIG. 2).

In an exemplary embodiment, the tabs 274 and/or 272 may include fingers 324 extending forward of the front ends of the tabs 274, 272. The fingers 324 may be oriented perpendicular to the fingers 322. Distal ends of the fingers 324 may be coplanar with the distal ends of the fingers 322 and provide a surface for interfacing with the conductive gasket 202 (shown in FIG. 2).

The holder 120 includes alignment features 330, 332 on the first and second sides 260, 262, respectively. In the illustrated embodiment, the alignment feature 330 is represented by a post and the alignment feature 332 is represented by an opening 328. The alignment feature 330 is configured to be received within the alignment feature 332 of an adjacent holder 120. Optionally, the alignment feature 330 may be securely held within the alignment feature 332 of the adjacent holder 120 by an interference fit. For example, the alignment feature 332 may include bulges 334 that extend into the opening 328. Other types of alignment features are possible in alternative embodiments. Additionally, more than one alignment feature 330 may be provided on the first side 226 and more than one alignment feature 332 may be provided on the second side 228.

Figure 8:
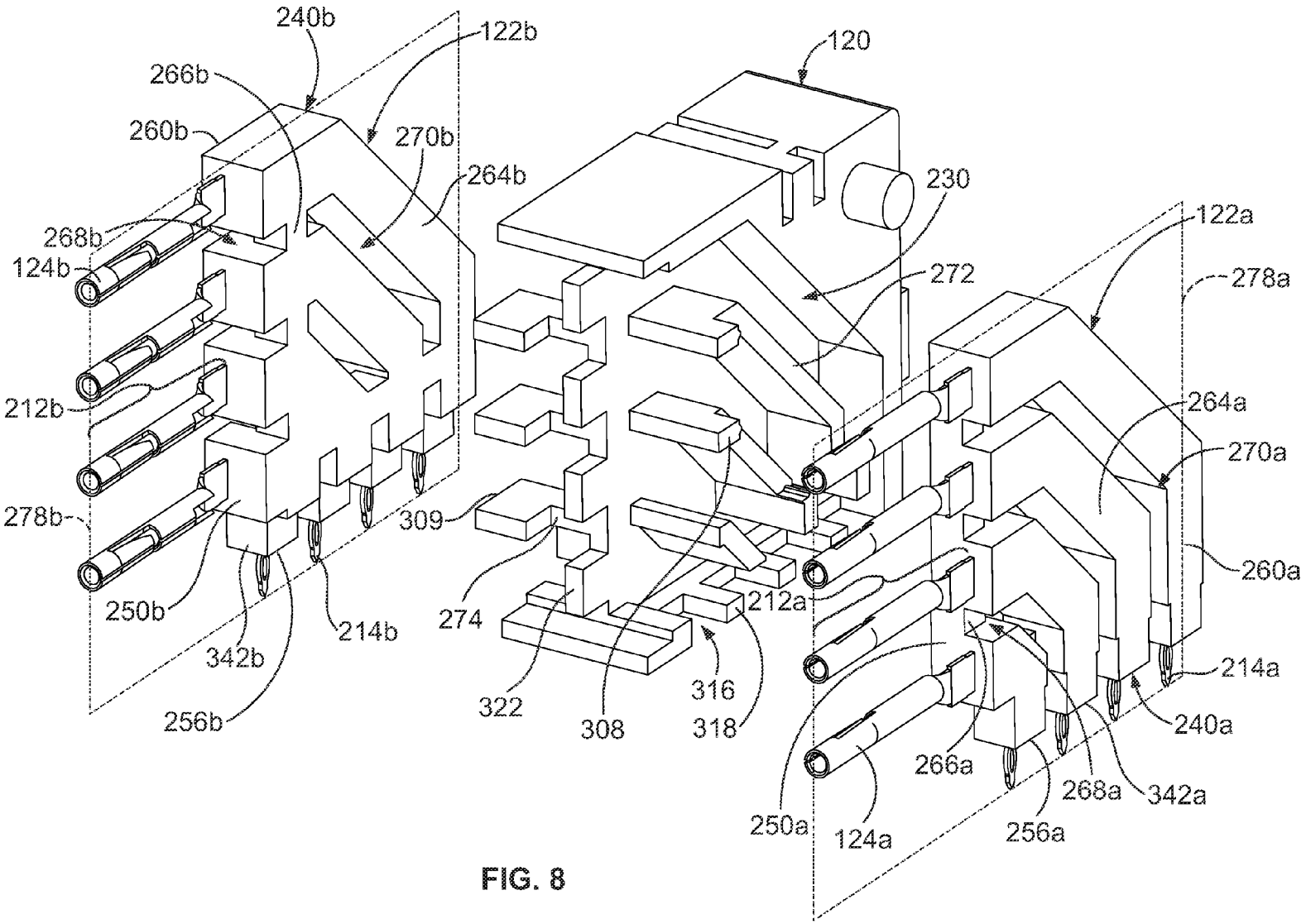
FIG. 8 is an exploded view of one of the holders and corresponding contact modules from one side.
Figure 9:
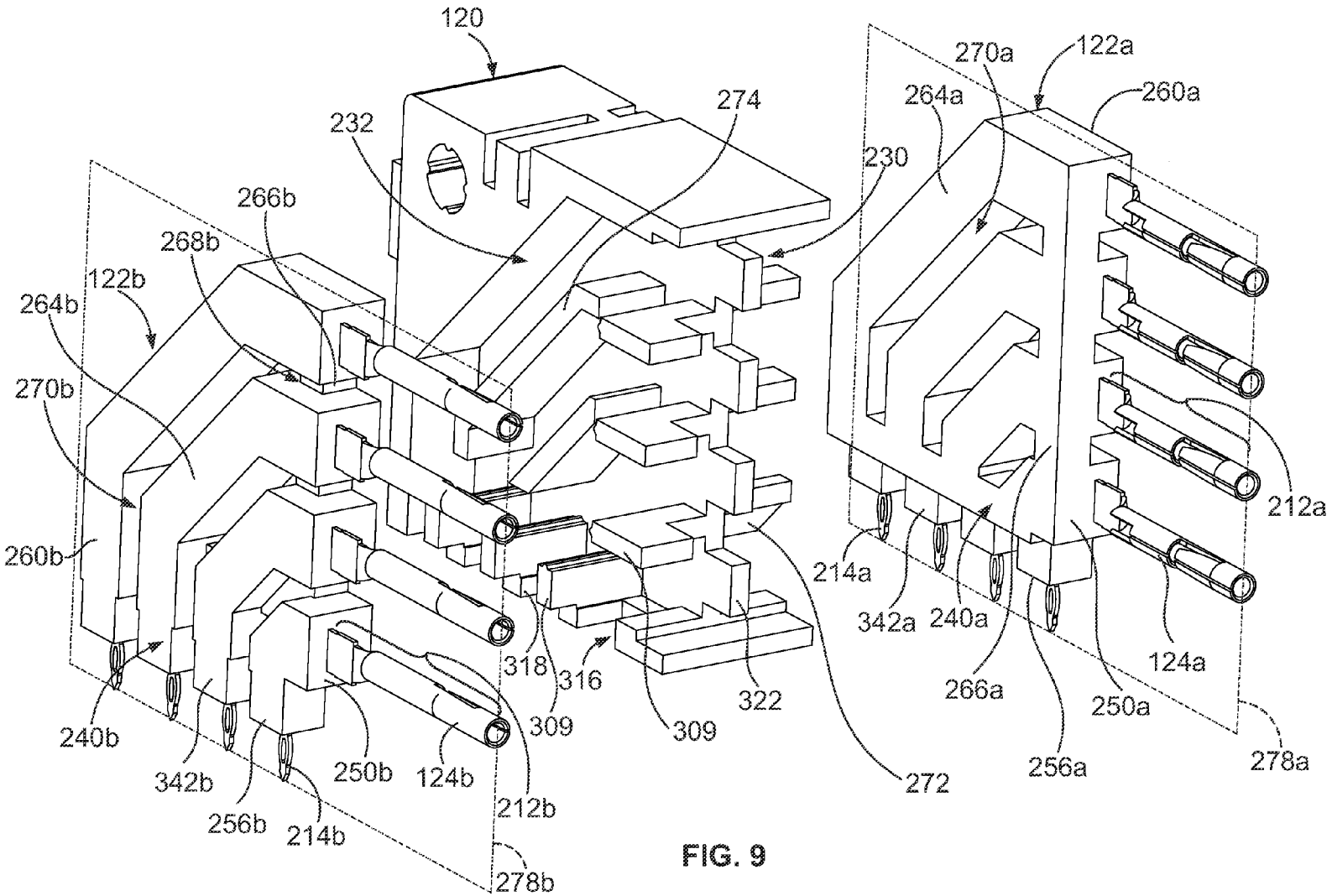
FIG. 9 is an exploded view of one of the holders and corresponding contact modules from another side.

FIGS. 8 and 9 are front perspective views from different sides of one of the holders 120 and corresponding contact modules 122*a* and 122*b* poised for coupling to the holder 120. The contact modules 122*a*, 122*b* are substantially similar to one another, and include similar components. The components of the contact module 122*a* will be designated with an "a" designation. The components of the contact module 122*b* will be designated with a "b" designation. The contact module 122*a* is configured to be received in the first receptacle chamber 230. The contact module 122*b* is configured to be received in the second receptacle chamber 232. While the contact modules 122*a*, 122*b* are illustrated as being mirrored images of one another, it is realized that the contact modules 122*a*, 122*b* may be different from one another and include different features.

The contact module 122*a* includes the frame members 264*a* and the connecting segments 266*a* therebetween. The connecting segments 266*a* are provided along the front wall 250*a* and the bottom wall 256*a*. The notches 268*a* extend inward from the first side 260*a* to the connecting segments. When assembled, no portion of the holder 120 that holds the contact module 122*a* is received in the notches 268*a*. However, tab projections 309 from an adjacent holder 120 (not shown) are configured to be received in the notches 268*a*. In an exemplary embodiment, the notches 268*a* extend beyond the contact plane 278*a*. As such, when the tab projections 309 from the adjacent holder 120 are received in the notches 268*a*, the tab projections 309 extend across the contact plane 278*a*. The tab projections 309 of the adjacent holder 120 provide shielding between the receptacle contacts 124*a*.

During assembly, the contact module 122*a* is loaded into the first receptacle chamber 230 such that the tabs 272 are received in the windows 270*a*, as illustrated in FIG. 3. The windows 270*a* are provided in the transition areas 286 between corresponding transition sections 282 (both shown in FIG. 5). As such, the windows 270*a* extend along, and are provided between, adjacent receptacle contacts 124*a* within the dielectric frame 240*a*. The tabs 272 provide electrical shielding between adjacent receptacle contacts 124*a*. The tabs 272 provide electrical shielding between edge sides 292 and 294 (shown in FIG. 5) of adjacent receptacle contacts 124*a*. The tabs 272 provide electrical shielding along the entire length of the respective window 270*a*. Depending on the size and length of the window 270*a* and corresponding tab 272, the contacts 124*a* may be electrically shielded along a majority of the length of the transition sections 282.

The frame members 264*a* include leg portions 342*a* at the bottom wall 256*a*. The contact tails 214*a* extend outward from respective leg portions 342*a*. When the contact module 122*a* is loaded into the receptacle chamber 230, the leg portions 342*a* are received in the openings 316. The fingers 318 are positioned between the frame members 264*a* and are thus provided between the portions of the receptacle contacts 124*a* extending through the leg portions 342*a*. The fingers 318 provide shielding between such portions of the receptacle contacts 124*a*.

The mating portions 212*a* extend from the front wall 250*a*. When the contact module 122*a* is loaded into the receptacle chamber 230, the fingers 322 provide shielding between the receptacle contacts 124*a* of the contact module 122*a* and the receptacle contacts 124*b* of the contact module 122*b*.

The contact module 122*b* includes the frame members 264*b* and the connecting segments 266*b* therebetween. The connecting segments 266*b* are provided along the front wall 250*b* and the bottom wall 256*b*. The notches 268*b* extend inward from the first side 260*b* to the connecting segments. When assembled, no portion of the holder 120 that holds the contact module 122*b* is received in the notches 268*b*. However, tab projections 308 from an adjacent holder 120 (not shown) are configured to be received in the notches 268*b*. In an exemplary embodiment, the notches 268*b* extend beyond the contact plane 278*b*. As such, when the tab projections 308 from the adjacent holder 120 are received in the notches 268*b*, the tab projections 308 extend across the contact plane 278*b*. The tab projections 308 of the adjacent holder 120 provide shielding between the receptacle contacts 124*b*.

During assembly, the contact module 122*b* is loaded into the second receptacle chamber 232 such that the tabs 274 are received in the windows 270*b*, as illustrated in FIG. 4. The windows 270*b* extend along, and are provided between, adjacent receptacle contacts 124*b* within the dielectric frame 240*b*. The tabs 274 provide electrical shielding between adjacent receptacle contacts 124*b*. The tabs 274 provide electrical shielding between edge sides 292 and 294 (shown in FIG. 5) of adjacent receptacle contacts 124*b*. The tabs 274 provide electrical shielding along the entire length of the respective window 270*b*.

The frame members 264*b* include leg portions 342*b* at the bottom wall 256*b*. The contact tails 214*b* extend outward from respective leg portions 342*b*. When the contact module 122*b* is loaded into the receptacle chamber 232, the leg portions 342*b* are received in the openings 316. The fingers 318 are positioned between the frame members 264*b* and are thus provided between the portions of the receptacle contacts 124*b* extending through the leg portions 342*b*. The fingers 318 provide shielding between such portions of the receptacle contacts 124*b*.

The mating portions 212*b* extend from the front wall 250*b*. When the contact module 122*b* is loaded into the receptacle chamber 232, the fingers 322 provide shielding between the receptacle contacts 124*a* of the contact module 122*a* and the receptacle contacts 124*b* of the contact module 122*b*.

Returning to FIG. 2, after the contact modules 122*a*, 122*b* are loaded into the corresponding holders 120, the holders 120 (any number of which may be provided depending on the particular application) are ganged together and coupled to one another. The end holders 132, 134 are then provided at the corresponding ends. The end holder 132 supports a contact module 122*b* and the end holder 134 supports a contact module 122*a*. The end holder 132 has a support wall 346 that may be similar to the support wall 224 of one of the holders 120, however the support wall 346 only includes tabs (not shown, but similar to the tabs 274) extending from one side of the support wall 346 and only defines a single receptacle chamber 348 that receives the corresponding contact module 122*b*. An outer surface 350 of the support wall 346 is generally planar and defines an outer surface of the receptacle assembly 102. The end holder 134 includes a support wall 352 that may be similar to the support wall 224 of one of the holders 120, however the support wall 352 only includes tabs (not shown, but similar to the tabs 272) extending from one side of the support wall 352 and only includes a single receptacle chamber 354 that receives the corresponding contact module 122*a*. The support wall 352 includes an outer surface 356 that is substantially planar and defines an outer surface of the receptacle assembly 102.

Returning to FIGS. 3 and 4, in an exemplary embodiment, the contact modules 122*a* and 122*b* are arranged in contact module sets 360. Each contact module set 360 includes a plurality of the differential pairs 129 of receptacle contacts 124. Each contact module set 360 includes one of the contact modules 122*a* and one of the contact modules 122*b*. One of the receptacle contacts 124*a* of each differential pair 129 is held by the contact module 122*a* and the other receptacle contact 124*b* is held by the contact module 122*b*.

The contact modules 122*a*, 122*b* within a particular contact module set 360 are arranged within different holders 120 (or end holders 134, 132) that are adjacent to each other. The contact modules 122*a*, 122*b* within a particular contact module set 360 are arranged between the support wall 224 of one holder 120 and the support wall 224 of the adjacent holder 120. The contact modules 122*a*, 122*b* within a particular holder 120 form parts of different contact module sets 360. The contact module sets 360 are separated from adjacent contact module sets 360 by the support walls 224.

The support walls 224 provide electrical shielding between adjacent contact module sets 360. Additionally, the top 223, the rear 221, the front 220 and the bottom 222 of the holders 120 surround and enclose the contact modules 122*a*, 122*b* of the contact module set 360. As such, each contact module set 360 is electrically shielded by the holders 120. In an exemplary embodiment, the holders 120 substantially circumferentially surround the differential pairs 129 of receptacle contacts 124 along the length of the receptacle contacts between the contact tails 214 and the mating portions 212. For example, the support walls 224 and the tabs 272, 274 provide electrical shielding around the receptacle contacts 124. The tab projections 308, 309 provide shielding in the tab openings 300 within the notches 268.

As shown in FIG. 3, at the right side when looking at the front of the holders 120, the holders 120 include a plurality of the projections 308, identified as 600, 602, 604, 606 and 608. Any number of projections 308 may be provided in alternative embodiments. The projections 308 extend beyond the side 260 of the contact module 122. The holders 120 include a plurality of tab openings 300, identified as 610, 612, 614, 616, 618 and 620. The tab openings 610, 612 and 614 are provided forward of main segments 622 of the tabs 272. The tab openings 616, 618, 620 are provided below the main segments 622 of the tabs 272, between such main segments 622 and the fingers 318. The tab openings 300 are aligned with the notches 268 and connecting segments 266. The tab openings 300 provide a space that allows the connecting segments 266 to be loaded into the holder 120 and rest against the support wall 224.

As shown in FIG. 4, at the left side when looking at the front of the holders 120, the holders 120 include a plurality of the projections 309, identified as 630, 632, 634, 636, 638 and 640. Any number of projections 309 may be provided in alternative embodiments. The projections 309 extend beyond the side 262 of the contact module 122. The holders 120 include a plurality of tab openings 300, identified as 650, 652, 654, 656 and 658. The tab openings 650 and 652 are provided between main segments 660 of corresponding tabs 274 and front segments 626 of such tabs 274. The tab openings 656 and 658 are provided between the main segments 660 of the tabs 274 and the fingers 318. The tab openings 300 provide a space that allows the connecting segments 266 to be loaded into the holder 120 and rest against the support wall 224.

During assembly, when the holders 120 are mated together, the projections 600, 602, 604, 606 and 608 are loaded into the tab openings 650, 652, 654, 656 and 658, respectively, of the adjacent holder 120. The projections 600, 602, 604, 606 and 608 are loaded into the notches 268, and may abut against the connecting segments 266 of the contact module 122 held by the adjacent holder 120. The projections 600, 602, 604, 606 and 608 are loaded into the notches 268 across the contact plane 278 of the contact module 122 held by the adjacent holder 120. The projections 600, 602, 604, 606 and 608 are positioned between the receptacle contacts 124 held by the adjacent holder 120. The projections 600, 602, 604, 606 and 608 are aligned with, and extend through, a bisector defined between the edge sides 292 and 294 (shown in FIG. 5).

During assembly, when the holders 120 are mated together, the projections 630, 632, 634, 636, 638 and 640 are loaded into the tab openings 610, 612, 614, 616, 618 and 620, respectively, of the adjacent holder 120. The projections 630, 632, 634, 636, 638 and 640 are loaded into the notches 268, and may abut against the connecting segments 266 of the contact module 122 held by the adjacent holder 120. The projections 630, 632, 634, 636, 638 and 640 are loaded into the notches 268 across the contact plane 278 of the contact module 122 held by the adjacent holder 120. The projections 630, 632, 634, 636, 638 and 640 are positioned between the receptacle contacts 124 held by the adjacent holder 120. The projections 630, 632, 634, 636, 638 and 640 are aligned with, and extend through, a bisector defined between the edge sides 292 and 294.

Having the projections 308 or 309 extending into the tab openings 300 provides shielding along portions of the receptacle contacts 124 that would otherwise be unshielded. For example, without the projections, the receptacle contacts 124 would only be separated by dielectric material across the tab openings 300. However, by at least partially filling the tab openings 300 with conductive material, such as the tab projections 308, 309 that are disposed in the notches 268, shielding is improved. The holders 120, when assembled together, thus provide 360° shielding around the differential pairs along the entire lengths 284 of the transition sections 282 (both shown in FIG. 5) of the receptacle contacts 124.

Figure 10:
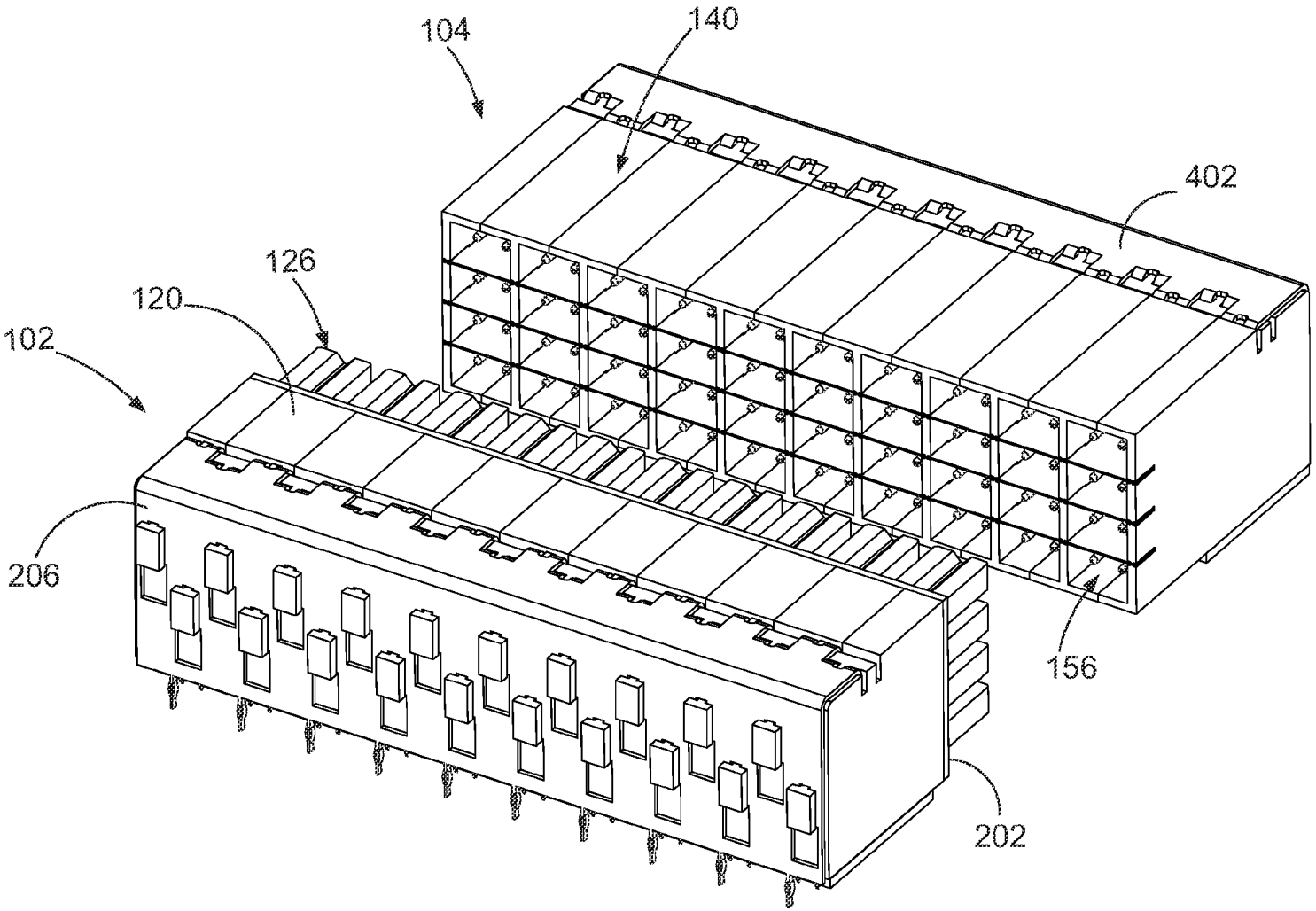
FIG. 10 illustrates the receptacle assembly being mated to the header assembly.

FIG. 10 illustrates the receptacle assembly 102 being mated to the header assembly 104. The retainer 206 is coupled to the holders 120 to secure the holders 120 together. The mating housing 126 extends forward from the holders 120 and is configured to be received in the loading chambers 156 of the header assembly 104. When assembled, the mating housing 126 is surrounded by the holders 140 of the header assembly 104. The holders 140 provide electrical shielding for the mating housing 126. The gasket 202 provides a grounding interface between the holders 120 and the holders 140. The header assembly 104 includes a retainer 402 coupled to each of the holders 140. The retainer 402 secures each of the holders 140 together.

Figure 11:
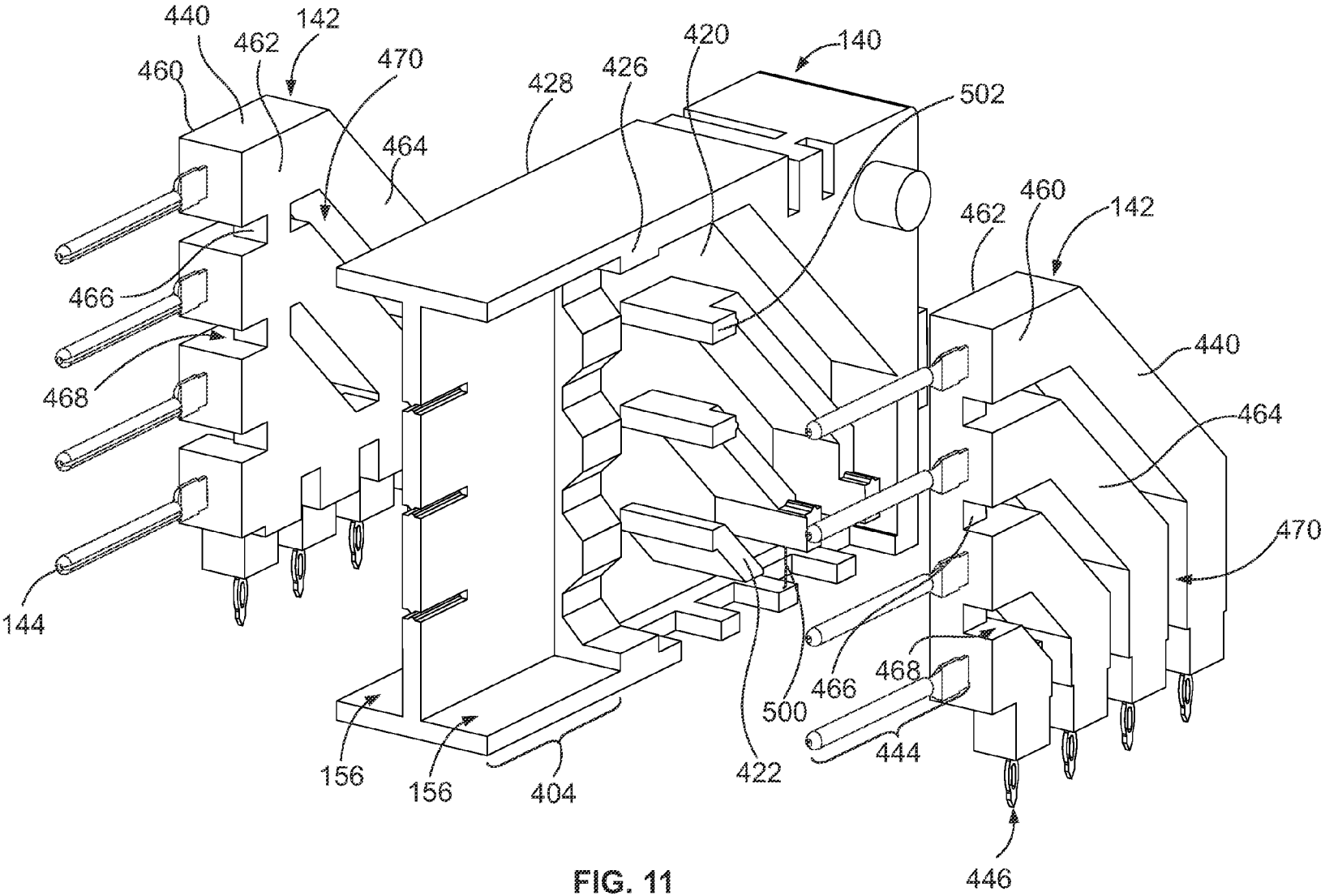
FIG. 11 is a partial exploded view of a portion of a holder and contact modules for the header assembly from one side.
Figure 12:
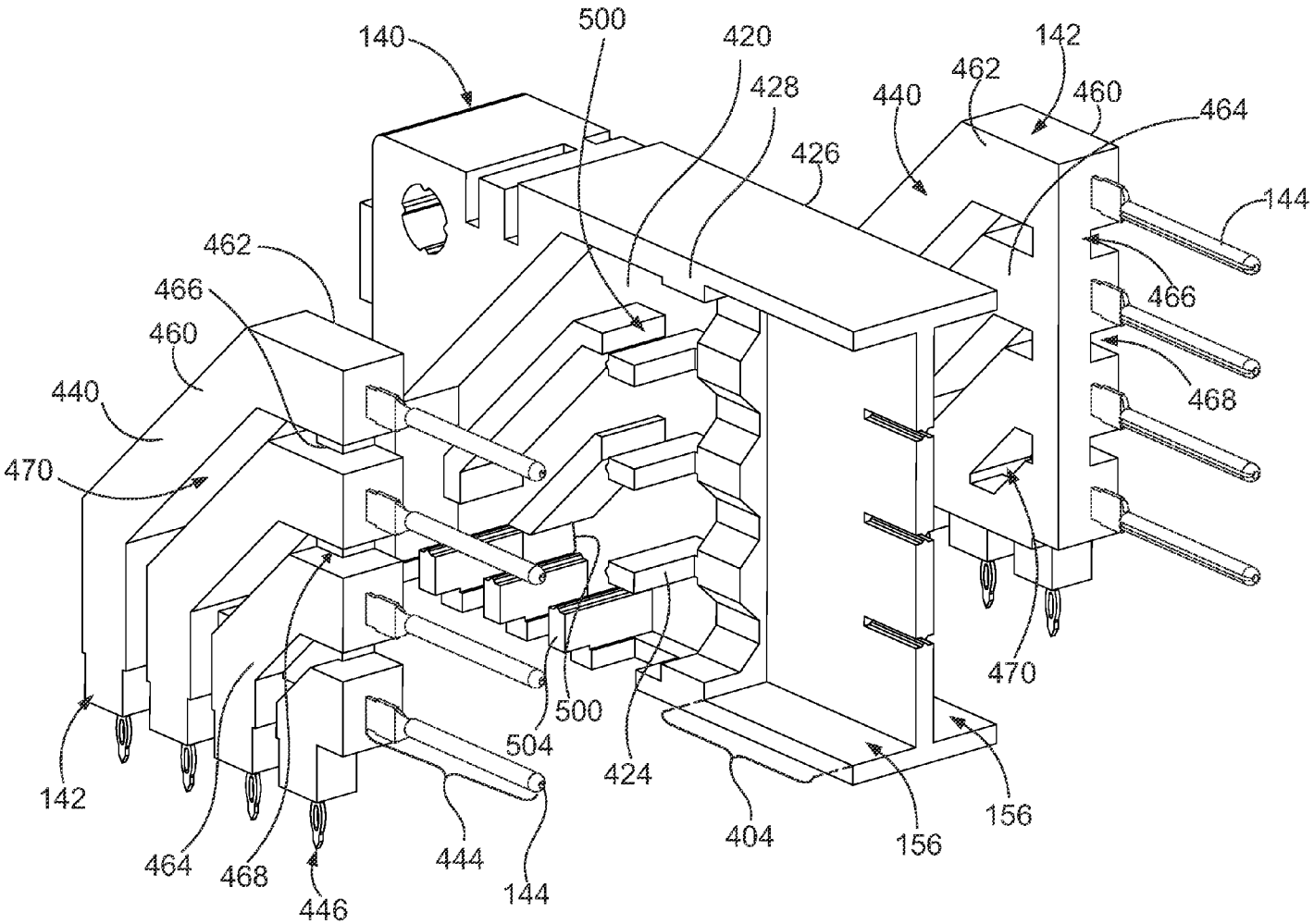
FIG. 12 is a partial exploded view of a portion of the holder and contact modules for the header assembly from another side.

FIGS. 11 and 12 are partial exploded views from opposite sides of the holder 140 and contact modules 142 for the header assembly 104. The holder 140 is similar to the holder 120 (shown in FIG. 3) and includes similar features. Unlike the holder 120, the holder 140 has a front extension 404 that defines the loading chamber 156 (shown in FIG. 1). The contact modules 142 are similar to the contact modules 122 (shown in FIG. 3) and include similar features, however the contact modules 142 hold the header contacts 144, which are different than the receptacle contacts 124 (shown in FIG. 3).

The holder 140 includes a support wall 420. The support wall 420 provides shielding between the contact modules 142. The holder 140 includes tabs 422, 424 that extend from opposite sides of the support wall 424. The tabs 422, 424 may be similar to the tabs 272, 274 (shown in FIGS. 3 and 4). The tabs 422, 424 generally extend to sides 426, 428, respectively, of the holder 140.

Each contact module 142 includes a dielectric frame 440 surrounding the header contacts 144. Each of the header contacts 144 includes a mating portion 444 at one end thereof and a contact tail 446 at an opposite end thereof. The mating portions 444 constitute pin contacts having a generally cylindrical shape that is configured to be received within the barrel portions of the receptacle contacts 124. The contact tails 446 constitute press-fit pins, such as eye-of-the-needle contacts that are configured to be received in plated vias in the circuit board 108 (shown in FIG. 1).

The dielectric frame 440 includes a first side 460 and a second side 462 generally opposite the first side 460. The first and second sides 460, 462 are generally parallel to the sides 426, 428 of the holder 140. When assembled, the first and second sides 460, 462 may be generally coplanar with the sides 426, 428 of the holder 140.

The dielectric frame 440 includes a plurality of frame members 464. The frame members 464 hold the header contacts 144. The frame members 464 are spaced apart from one another and interconnected by connecting segments 466. Optionally, each frame member 464 is connected to an adjacent frame member 464 by more than one connecting segment 466. The connecting segments 466 are narrower than the frame members 464. In an exemplary embodiment, the dielectric frame 440 includes notches 468 aligned with the connecting segments 466. The notches 468 extend inward from the first side 460 to the connecting segment 466.

The dielectric frame 440 includes a plurality of windows 470 extending through the dielectric frame 440 between the frame members 464. The windows 470 separate the frame members 464 from one another. In an exemplary embodiment, the windows 470 extend entirely through the dielectric frame 440 between the first and second sides 460, 462.

The tabs 422, 424 extend into the notches 468 and the windows 470 when the contact modules 142 are coupled to the holders 140 and when the holders 140 are coupled together. The tabs 422, 424 provide shielding between the adjacent header contacts 144.

The tabs 422, 424 include tab openings 500 between different tab segments of the tabs 422, 424. The tab openings 500 open to the support wall 420. The tabs 422, 424 include projections 502, 504, respectively, extending outward from outer edges of the tabs 422, 424. The projections 502, 504 are configured to be received within corresponding tab openings 500 of an adjacent holder 140. When the projections 502, 504 are received in the tab openings 500 of the adjacent holders 140, the projections 502, 504 are at least partially received in the notches 468 of the contact module 142 held by the adjacent holder 140.

Figure 14:
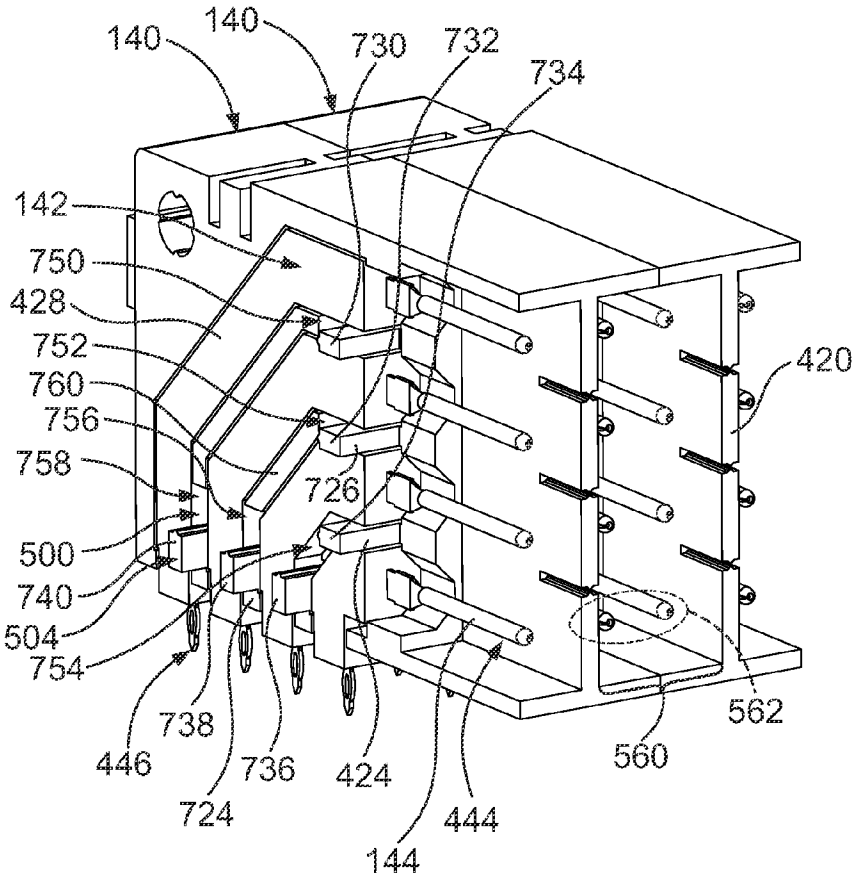
FIG. 14 is a front perspective view of the header assembly from another side.
Figure 13:
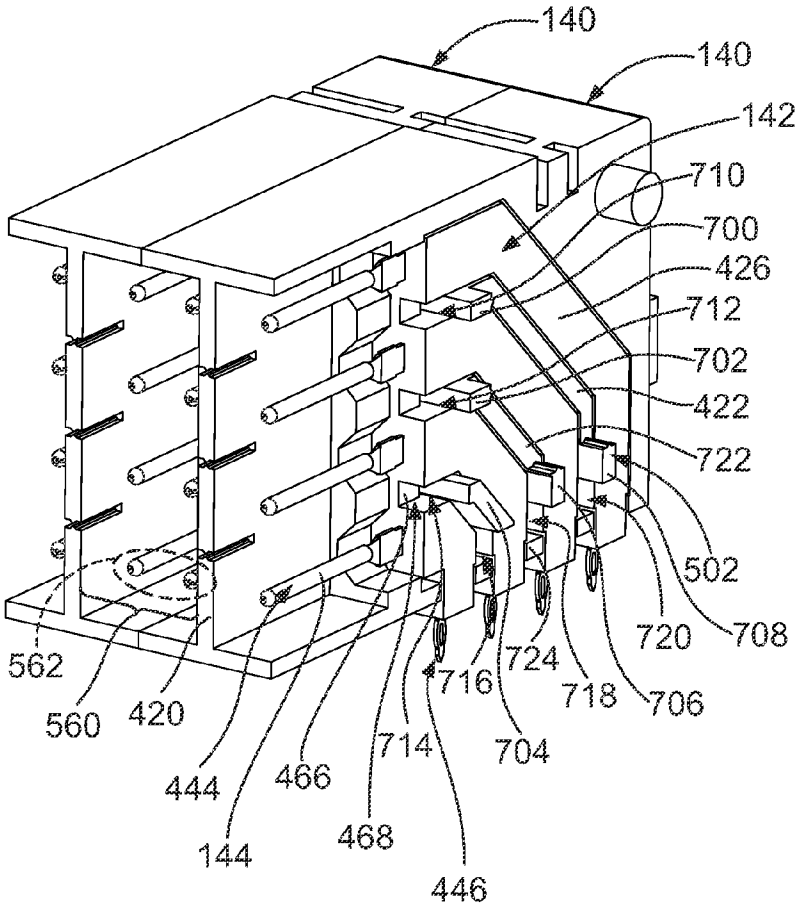
FIG. 13 is a front perspective view of the header assembly from one side.

FIGS. 13 and 14 are front perspective views from opposite sides of the holder 140 and contact modules 142 in an assembled state. The contact modules 142 are loaded into the corresponding holders 140 (any number of which may be provided depending on the particular application), which are then ganged together and coupled to one another to form the header assembly 104 (shown in FIG. 10). In an exemplary embodiment, the contact modules 142 are arranged in contact module sets 560. Each contact module set 560 includes a plurality of the differential pairs 562 of header contacts 144. Each contact module set 560 includes one contact module 142 held in one of the holders 140 and a corresponding contact module 142 held in the adjacent holder 140. One of the header contacts 144 of each differential pair 562 is held by the contact module 142 in the first holder and the other header contact 144 is held by the contact module 142 in the adjacent second holder. The contact modules 142 within a particular contact module set 560 are arranged within different holders 140 that are adjacent to each other. The contact modules 142 within a particular contact module set 560 are arranged between the support wall 420 of one holder 140 and the support wall 420 of the adjacent holder 140. The contact module 142 within a particular holder 140 form parts of different contact module sets 560. The contact module sets 560 are separated from adjacent contact module sets 560 by the support walls 420. The support walls 420 provide electrical shielding between adjacent contact module sets 560.

In an exemplary embodiment, the holders 140 substantially circumferentially surround the differential pairs 562 of header contacts 144 along the length of the header contacts 144 between the contact tails 446 and the mating portions 444. For example, the support walls 440 and the tabs 422, 424 provide electrical shielding around the header contacts 144. The tab projections 502, 504 provide shielding in the tab openings 500 within the notches 468.

As shown in FIG. 13, at the right side when looking at the front of the holders 140, the holders 140 include a plurality of the projections 502, identified as 700, 702, 704, 706 and 708. Any number of projections 502 may be provided in alternative embodiments. The projections 502 extend beyond the side 426 of the contact module 142. The holders 140 include a plurality of tab openings 500, identified as 710, 712, 714, 716, 718 and 720. The tab openings 710, 712 and 714 are provided forward of main segments 722 of the tabs 422. The tab openings 716, 718, 720 are provided below the main segments 722 of the tabs 272, between such main segments 722 and fingers 724. The tab openings 500 are aligned with the notches 468 and connecting segments 466. The tab openings 500 provide a space that allows the connecting segments 466 to be loaded into the holder 140 and rest against the support wall 420.

As shown in FIG. 14, at the left side when looking at the front of the holders 140, the holders 140 include a plurality of the projections 504, identified as 730, 732, 734, 736, 738 and 740. Any number of projections 504 may be provided in alternative embodiments. The projections 504 extend beyond the side 428 of the contact module 142. The holders 140 include a plurality of tab openings 500, identified as 750, 752, 754, 756 and 758. The tab openings 750 and 752 are provided between main segments 760 of corresponding tabs 424 and front segments 726 of such tabs 424. The tab openings 756 and 758 are provided between the main segments 760 of the tabs 424 and the fingers 724. The tab openings 500 provide a space that allows the connecting segments 466 (shown on FIG. 12) to be loaded into the holder 140 and rest against the support wall 420.

During assembly, when the holders 140 are mated together, the projections 700, 702, 704, 706 and 708 are loaded into the tab openings 750, 752, 754, 756 and 758, respectively, of the adjacent holder 140. The projections 700, 702, 704, 706 and 708 are loaded into the notches 468, and may abut against the connecting segments 466 of the contact module 142 held by the adjacent holder 140. The projections 700, 702, 704, 706 and 708 are loaded into the notches 468 across a contact plane of the contact module 142 held by the adjacent holder 140. The projections 700, 702, 704, 706 and 708 are positioned between the header contacts 144 held by the adjacent holder 140.

During assembly, when the holders 140 are mated together, the projections 730, 732, 734, 736, 738 and 740 are loaded into the tab openings 710, 712, 714, 716, 718 and 720, respectively, of the adjacent holder 140. The projections 730, 732, 734, 736, 738 and 740 are loaded into the notches 468, and may abut against the connecting segments 466 of the contact module 142 held by the adjacent holder 140. The projections 730, 732, 734, 736, 738 and 740 are loaded into the notches 468 across the contact plane of the contact module 142 held by the adjacent holder 140. The projections 730, 732, 734, 736, 738 and 740 are positioned between the header contacts 144 held by the adjacent holder 140.

Having the projections 502 or 504 extending into the tab openings 500 provides shielding along portions of the header contacts 144 that would otherwise be unshielded. For example, without the projections, the header contacts 144 would only be separated by dielectric material across the tab openings 500. However, by at least partially filling the tab openings 500, such as through the notches 468 to the connecting segments 466, the tab projections 502, 504 are positioned between the header contacts 144 even in the space defined by the tab openings 500. The holders 140, when assembled together, thus provide 360° shielding around the differential pairs 562 along the entire lengths of the transition sections of the header contacts 144.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

contact modules each having a dielectric frame and contacts held by the dielectric frame, the contacts being arranged along a contact plane within the frame, the dielectric frame includes frame members connected by connecting segments, the frame having windows between the frame members located between adjacent contacts; and holders supporting corresponding contact modules, the holders being electrically grounded, the holders each having a support wall and tabs extending outward from the support wall, the contact modules being coupled to the holders such that the tabs are received in the windows to provide shielding within the contact modules, the holders being coupled together such that the contact modules are stacked together with the tabs of at least some of the holders extending into the contact module held by the adjacent holder and across the contact plane defined by the contact module of the adjacent holder.

2. The connector assembly of claim 1, wherein the tabs extend generally perpendicular to the contact plane, the tabs extending across the contact plane defined by the contact module held by the adjacent holder provide shielding between contacts in different frame members of the contact module held by the adjacent holder.

3. The connector assembly of claim 1, wherein the contact modules have front walls and bottom walls, the contacts extending outward from corresponding front walls and bottom walls, the contacts have interior lengths defined between the front walls and bottom walls, the support wall and tabs providing circumferential shielding along the entire interior lengths of the contacts.

4. The connector assembly of claim 1, wherein the holders have mating ends and mounting ends, the tabs extend between the mating ends and mounting ends and include tab openings through the tabs, wherein the holders are coupled together such that tabs of adjacent holders substantially fill the tab openings to provide continuous shielding between the mating ends and the mounting ends.

5. The connector assembly of claim 1, wherein the contacts have a rectangular cross section having broad sides and edge sides narrower than the broad sides, the broad sides being parallel to the contact planes, the contacts being held by corresponding dielectric frames such that the broad sides face support walls of adjacent holders and the edge sides face the tabs, the tabs include projections extending into contact modules held by adjacent holders such that the projections are positioned between edge sides of contacts in different frame members.

6. The connector assembly of claim 1, wherein the holders comprise a first holder and a second holder, the first holder having tabs comprising tab projections, the second holder having tabs comprising tab openings, the tab projections of the first holder extending into the tab openings of the second holder such that the tab projections are positioned between contacts in different frame members of the contact module held by the second holder.

7. The connector assembly of claim 1, wherein the connecting segments are narrower than the frame members to define notches between the frame members aligned with the connecting segments, the holders being coupled together such that the tabs of at least some of the holders extend into the notches between adjacent frame members.

8. The connector assembly of claim 1, wherein the holders are coupled together such that the tabs of adjacent holders are interdigitated with the tabs of one holder being at least partially received in the windows of the contact module held by the adjacent holder.

9. The connector assembly of claim 1, wherein the holder has an outer perimeter along a side of the holder, the tabs having outer edges coplanar with the side of the holder, the tabs having projections extending outward beyond the side, the projections extend into the contact module held by the adjacent holder beyond the contact plane of the contact module of the adjacent holder.

10. The connector assembly of claim 1, wherein the support wall of each holder includes a first side and a second side, the tabs extending from the support wall extend from both the first side and from the second side, each of the holders supports one of the contact modules on the first side and one of the contact modules on the second side.

11. The connector assembly of claim 1, wherein the contact modules are arranged in contact module sets with two contact modules in each contact module set, the contacts being arranged in differential pairs with the contacts of each differential pair being arranged in different contact modules of the corresponding contact module set, the holders being ganged together such that the support walls of adjacent holders flank the corresponding contact module sets.

12. A connector assembly comprising:

contact modules each having a dielectric frame and contacts held by the dielectric frame, the dielectric frame includes frame members connected by connecting segments, the connecting segments being narrower than the frame members to define notches between the frame members aligned with the connecting segments, the frame having windows between the frame members located between adjacent contacts; and holders supporting corresponding contact modules, the holders being electrically grounded, the holders each having a support wall and tabs extending outward from the support wall, the contact modules being coupled to the holders such that the tabs are received in the windows to provide shielding within the contact modules between the contacts in adjacent frame members, the holders being coupled together such that the tabs of at least some of the holders extend into the notches between adjacent frame members.

13. The connector assembly of claim 12, wherein the contacts extend along contact planes within the dielectric frames, the tabs extend generally perpendicular to the contact plane, the tabs extend across the contact plane defined by the contact module held by the adjacent holder to provide shielding between contacts in different frame members of the contact module held by the adjacent holder.

14. The connector assembly of claim 12, wherein the contact modules have front walls and bottom walls, the contacts extending outward from corresponding front walls and bottom walls, the contacts have interior lengths defined between the front walls and bottom walls, the support wall and tabs providing circumferential shielding along the entire interior lengths of the contacts.

15. The connector assembly of claim 12, wherein the holders have mating ends and mounting ends, the tabs extend between the mating ends and mounting ends and include tab openings through the tabs, wherein the holders are coupled together such that tabs of adjacent holders substantially fill the tab openings to provide continuous shielding between the mating ends and the mounting ends.

16. The connector assembly of claim 12, wherein the contacts extend along contact planes within the dielectric frames, the contacts having a rectangular cross section having broad sides and edge sides narrower than the broad sides, the broad sides being parallel to the contact planes, the contacts being held by corresponding dielectric frames such that the broad sides face support walls of adjacent holders and the edge sides face the tabs, the tabs include projections extending into contact modules held by adjacent holders such that the projections are positioned between edge sides of contacts in different frame members.

17. The connector assembly of claim 12, wherein the holders comprise a first holder and a second holder, the first holder having tabs comprising tab projections, the second holder having tabs comprising tab openings, the tab projections of the first holder extending into the tab openings of the second holder such that the tab projections are positioned between contacts in different frame members of the contact module held by the second holder.

18. The connector assembly of claim 12, wherein the connecting segments are narrower than the frame members to define notches between the frame members aligned with the connecting segments, the holders being coupled together such that the tabs of at least some of the holders extend into the notches between adjacent frame members.

19. The connector assembly of claim 12, wherein the holder has an outer perimeter along a side of the holder, the tabs having outer edges coplanar with the side of the holder, the tabs having projections extending outward beyond the side, the projections extend into the contact module held by the adjacent holder such that the tab is positioned between corresponding contacts of the contact module held by the adjacent holder.

* * * * *